US007029541B2

(12) United States Patent
Diaddario, Jr. et al.

(10) Patent No.: US 7,029,541 B2
(45) Date of Patent: Apr. 18, 2006

(54) TRIVALENT CHROMATE CONVERSION COATING

(75) Inventors: Leonard L. Diaddario, Jr., Independence, OH (US); Michael Marzano, Concord, OH (US)

(73) Assignee: Pavco, Inc., Cleveland, OH (US)

( * ) Notice: Subject to any disclaimer, the term of this patent is extended or adjusted under 35 U.S.C. 154(b) by 440 days.

(21) Appl. No.: 10/056,530

(22) Filed: Jan. 24, 2002

(65) Prior Publication Data

US 2003/0145909 A1 Aug. 7, 2003

(51) Int. Cl.
*C23C 22/24* (2006.01)
*C23C 22/84* (2006.01)

(52) U.S. Cl. ..... 148/265; 148/244; 148/264; 148/267; 106/14.05

(58) Field of Classification Search ..... 148/260–268, 148/273, 244; 106/14.11, 14.05
See application file for complete search history.

(56) References Cited

U.S. PATENT DOCUMENTS

| | | | | |
|---|---|---|---|---|
| 2,393,640 | A * | 1/1946 | King | 148/244 |
| 3,932,198 | A | 1/1976 | Schneider | |
| 4,200,475 | A * | 4/1980 | Kasahara et al. | 148/244 |
| 4,263,059 | A | 4/1981 | Guhde et al. | |
| 4,302,246 | A | 11/1981 | Brindisi, Jr. et al. | |
| 4,349,392 | A | 9/1982 | Huvar | |
| 4,359,345 | A | 11/1982 | Da Fonte, Jr. | |
| 4,359,346 | A | 11/1982 | Da Fonte, Jr. | |
| 4,359,348 | A | 11/1982 | Crotty | |
| 4,367,099 | A | 1/1983 | Lash et al. | |
| 4,384,902 | A | 5/1983 | Crotty et al. | |
| 4,578,122 | A | 3/1986 | Crotty | |
| 4,801,337 | A * | 1/1989 | Higgins | 148/267 |
| 5,080,733 | A | 1/1992 | Deresh | |
| 5,178,690 | A | 1/1993 | Maiquez | |
| 5,200,292 | A * | 4/1993 | Shinozaki et al. | 430/178 |
| 5,268,042 | A | 12/1993 | Carlson | |
| 5,338,375 | A * | 8/1994 | Benderly et al. | 148/252 |
| 5,374,347 | A | 12/1994 | Pearlstein et al. | |
| 5,399,209 | A | 3/1995 | Suda et al. | |
| 5,415,702 | A | 5/1995 | Bishop et al. | |
| 5,691,048 | A * | 11/1997 | Roberto et al. | 428/334 |
| 5,711,996 | A | 1/1998 | Claffey | |
| 5,931,993 | A | 8/1999 | Bradley | |
| 5,968,240 | A | 10/1999 | Myers et al. | |
| 6,004,448 | A | 12/1999 | Martyak | |
| 6,027,578 | A | 2/2000 | Marzano | |
| 6,096,140 | A | 8/2000 | Susa et al. | |
| 6,159,547 | A | 12/2000 | McMordie et al. | |
| 6,280,535 | B1 * | 8/2001 | Miyoshi et al. | 148/264 |

FOREIGN PATENT DOCUMENTS

EP 0 995 816 A1 4/2000

* cited by examiner

*Primary Examiner*—Roy King
*Assistant Examiner*—Lois Zheng
(74) *Attorney, Agent, or Firm*—Fay, Sharpe, Fagan, Minnich & McKee, LLP

(57) ABSTRACT

In a preferred embodiment of the present invention, a conversion coating composition comprising chromium (III) ions, cobalt (II) ions, and nitric acid is provided. The coating composition is substantially free of chromium (VI) ions and substantially free of an oxidizing agent. The present trivalent chromium based conversion coating provides corrosion protection equal to or greater than most hexavalent chromium conversion coatings.

24 Claims, No Drawings

TRIVALENT CHROMATE CONVERSION COATING

BACKGROUND OF THE INVENTION

The present invention pertains to the art of metal surface treatment, and more particularly, to conversion coatings for plated metals.

The invention is particularly suited to treatment or passivation of zinc-plated metal surfaces using a trivalent-chromium conversion coating and will be described with particular reference thereto. It will be appreciated, however, that the invention has broader applications such as treatment of other types of plated or non-plated substrates.

In the metal finishing industry, conversion coatings are used to provide metal surfaces with improved corrosion resistance. Conversion coatings also provide metal surfaces with improved adhesion for additional coatings such as paint or other finishes. Widely used conversion coatings use hexavalent chromate. Such chromate conversion coatings are applied at various thicknesses, ranging from a very thin "blue-bright" finish to a very thick olive-drab finish. "Blue-bright" finishes are transparent with a slight blue tint and high luster. Such a finish not only imparts a corrosion-resistant coating to the surface of a substrate but also aesthetically enhances the substrate and articles made therefrom. Heavier chromate conversion coatings are considerably more protective than the bright finishes, but they do not meet the aesthetic criteria that are characteristic of the bright coatings. These heavier coatings are well-recognized by their yellow, bronze, or olive-drab finishes which correspond in general order to increasing film thickness.

Although conversion-coating techniques using hexavalent chromium provide satisfactory results, hexavalent chromium can be toxic. Therefore, the waste from a hexavalent chromium based solution creates significant environmental concerns and hexavalent chromium baths require special treatment prior to disposal.

There are non-chrome treatments for forming passivation coatings, but these are generally unsatisfactory for enhancing the corrosion resistance of a plated substrate, particularly when the treated substrate is subjected to a humid environment. Such treatments typically include phosphate treatments and a bright dipping step, followed by a coating step using a transparent lacquer. Each step provides an additional barrier layer to corrosive conditions, but not a cohesive film forming a chemical bond between a film-forming element and the coated substrate as is achieved by hexavalent chromium processes. Accordingly, phosphate treatments provide barriers that are porous, permitting moisture to pass through to the coated substrate. Phosphate coatings are also not bright in appearance, but provide dull, opaque paint-like overcoats lacking the aesthetic attributes of hexavalent chromium conversion coatings.

Hexavalent chromium-free treatments have been developed utilizing trivalent chromium. For example, U.S. Pat. No. 4,349,392 is directed to an aqueous acidic solution and process for treating metal surfaces, comprising chromium ions substantially all of which are in the trivalent state, hydrogen ions to provide a pH of about 1.2 to about 2.5, an oxidizing agent, a bath soluble and compatible organic carboxylic acid or metal salts, and at least one additional metal ion.

U.S. Pat. No. 4,359,345 teaches an aqueous acidic solution and process for treating metal surfaces comprising chromium ions substantially all of which are in the trivalent stet, hydrogen ions to provide a pH of about 1.5 to 2.2, an oxidizing agent, and iron ions in combination with at least one additional metal ion.

U.S. Pat. No. 4,359,346 is directed to an aqueous acidic solution and process for treating receptive metal surfaces containing chromium ions substantially all of which are in the trivalent state, hydrogen ions to provide a pH of about 1.2 to 2.5, an oxidizing agent, and cerium ions.

U.S. Pat. No. 4,359,348 teaches an aqueous acidic solution and process for treating metal surfaces. The solution contains chromium ions substantially all of which are present in the trivalent state, hydrogen ions to provide a pH of about 1.2 to 2.5, an oxidizing agent, a stabilizing agent, and at least one additional metal ion.

U.S. Pat. No. 4,367,099 teaches an aqueous acidic treating solution containing as its essential constituents chromium ions, substantially all of which are present in the trivalent state, hydrogen ions to provide a solution pH of about 1.2 to 2.5, an oxidizing agent, and at least one additional metal ion present in an amount effective to activate the bath and formation of a chromate passivate film of the desired appearance on the substrate treated.

U.S. Pat. No. 4,384,902 teaches an aqueous acidic solution containing chromium ions substantially all of which are in the trivalent state, hydrogen ions to provide a pH of about 1.2 to 2.5, an oxidizing agent, a bath soluble and compatible silicate compound to provide improved corrosion protection, and at least one additional metal ion.

U.S. Pat. No. 4,578,122 teaches an aqueous acidic treating solution comprising chromium ions substantially all of which are present in the trivalent state, hydrogen ions to provide an operating solution pH of about 1.2 to 2.5, nitrate ions as the essential oxidizing agent, and at least one additional activation metal ion. Importantly, the patent require at least 4:1 nitrate ions to chromium and activating metal ions, resulting in excess oxidizing agent which is damaging to the overall film quality and may lead to generation of undesirable Cr(VI).

Finally, U.S. Pat. No. 6,096,140 teaches a metallic surface treating solution with a pH of 0.1 to 6.5 comprising a source of at least one selected from the group consisting of Mo, W, V, Nb, Ta, Ti, Zr, Ce, Sr, and trivalent chromium, an oxidizing substance source, and an oxyacid or oxyacid salt of phosphorus or its anhydride.

In each of the above-described patents, an oxidizing agent is included as an essential ingredient in the hexavalent chromium-free solution. It is known in the art that the presence of oxidizing agents may lead to some conversion of trivalent chromium to hexavalent chromium during the formation of the conversion coating. The presence of this hexavalent chromium may then lead to some or all of the previously described problems. Furthermore, the inclusion of an oxidizing agent may add additional costs and steps to the formation of the conversion coatings.

Therefore, the development of a hexavalent chromium-free conversion coating that provides similar attributes to traditional hexavalent chromium systems is desirable. Such a hexavalent chromium-free coating is preferably substantially impervious to moisture and able to withstand a salt spray test for up to about 12 to 24 hours. Furthermore, the coating should simultaneously enhance the appearance of the substrate by imparting an attractive, brightly polished finish.

The present invention provides an aesthetically pleasing, and corrosion inhibiting, hexavalent chromium-free, trivalent chromium conversion coating.

SUMMARY OF THE INVENTION

According to one embodiment of the present invention, a conversion coating bath comprised of chromium (III) ions, cobalt (II) ions, and nitrate ions is provided. Nitrate ions are provided at a ratio relative to Cr and Co of less than 1.5:1. The coating composition is substantially free of chromium (VI) ions and substantially free of an oxidizing agent.

According to a preferred embodiment, the composition of a working conversion-coating solution comprises about 0.022 to 0.073 mole/L chromium (III) ions, about 0.011 to 0.035 mole/L cobalt (II) ions, a film-polishing agent, and about 0.013 to 0.045 mole/L nitrate ions. The coating composition is substantially free of chromium (VI) ions and substantially free of an oxidizing agent.

In another embodiment, a method for applying a conversion coating onto an article is provided. The method comprises the steps of plating the article with zinc and immersing the zinc plated article in a conversion-coating bath substantially free of chromium (VI) ions and substantially free of oxidizing agents, the bath comprising water, chromium (III) ions, cobalt (II) ions, fluoride ions, and nitrate ions. The article can then be rinsed and dried.

For purposes of this invention, the term "substantially free of chromium (VI) ions" is defined as a solution containing at most only trace amounts of chromium (VI) ions in such a minute concentration that the presence of these ions will have no affect on the desired properties of the coating, and will have no adverse environmental impact. Most preferably, the invention contains no chromium (VI) ions. Additionally, for the purposes of this invention, the term "substantially free of an oxidizing agent" is defined as a solution containing at most only trace amounts of oxidizing agents in such a minute concentration that the presence of these agents will have no affect on the desired properties of the coating. Most preferably, the invention contains no oxidizing agents. Oxidizing agents include peroxides and persulfates.

DETAILED DESCRIPTION OF THE PREFERRED EMBODIMENT

The present invention is directed to non-hexavalent chromium conversion coatings for use over electro-deposited zinc metal articles. The conversion coating can be used in combination with cyanide, alkaline non-cyanide and chloride zinc plating systems. The present trivalent chromium conversion-coating provides corrosion protection equal to or greater than most hexavalent chromate systems.

In an exemplary metal treatment operation, an iron-containing alloy such as steel is electroplated with zinc. After plating, the plated metal is rinsed, exposed to a mild inorganic acid, exposed to the present conversion coating, rinsed and dried.

More specifically, after zinc plating, the plated metal is rinsed twice with water and then dipped in a 0.1–0.5% by volume nitric acid or sulfuric acid solution for about 5 to 30 seconds. The step of dipping in nitric acid is particularly beneficial with alkaline non-cyanide plating systems, and may be omitted in chloride zinc systems. After these steps, the plated metal is immersed in a bath of the conversion coating composition of the present invention. The coated metal is then rinsed in water at between about 20° C. and 60° C. and dried.

The conversion coating composition includes film forming agents, pH buffers, stabilizers, and polishing agents. For ease of manufacturing, storage, and transportation, the conversion coating is produced in concentrated form. The concentrate is diluted to produce a working solution of the general composition described in the following table:

TABLE 1

| | Conversion coating composition | | |
|---|---|---|---|
| Component | Preferred Range (Moles/L) | More Preferred Range (Moles/L) | Most Preferred Range (Moles/L) |
| Chromium (III) | 0.020–0.075 | 0.030–0.060 | 0.035–0.050 |
| Cobalt (II) | 0.010–0.035 | 0.015–0.030 | 0.020–0.025 |
| Fluoride | 0.005–0.020 | 0.008–0.018 | 0.010–0.015 |
| Nitrate | 0.010–0.045 | 0.020–0.035 | 0.025–0.030 |
| pH | 1.5–3.0 | 2.0–2.5 | 2.1–2.3 |

The Cr(III) ions and the Co(II) ions may preferably be provided in the form of $Cr_2(SO_4)_3$ and $CoSO_4$. Without being bound by theory, it is believed that the sulfate ions function as film formers on the zinc plated surface. The sulfate ions also act as a buffer and control the pH of the solution while enhancing the stability of the solution. Nitric acid is used to partially oxidize the zinc surface. However, the nitric acid level employed is below a level resulting in oxidation of Cr(III) to Cr(VI). This can be achieved by employing a ratio of nitrate ions (resultant from nitric acid) to the combination of Cr and activator metal ions (e.g., Co) of less than 1.5:1; preferably less than 1:1; more preferably less than 0.5:1. Fluoride is used to polish the zinc surface. The Cr(III) ions and the Co(II) ions serve to form the conversion coating on the zinc plated surface.

The resulting coating is an aesthetically pleasing blue-bright coating. Furthermore, a colored chromate coating can be achieved by exposing a coated article to a dye, such as the Mordant family of diazo dyes, without degrading the corrosion protection of the coating. For example, a yellow coating can be produced with the use of Mordant Orange 6 dye. A suitable dye exposure time is about 5–40 seconds, whereby the dye is at a temperature between about 20 and 40° C. at a pH between about 9–12.

The concentrated form of the conversion coating composition is diluted before immersion of metal articles therein. Specifically, a bath of the conversion coating is prepared using a clean tank. The tank or the tank lining should be made from a material inert to the conversion coating, such as polyethylene, polyvinyl chloride (PVC), or stainless steel. Clean, 20 to 40° C. water is added to the tank to greater than about 90% of the tank's working volume, preferably about 95% of the working volume. Then, while mixing, preferably 3.0–10%, more preferably 4–8%, and most preferably 5–7% of the working volume of the tank is filled with the concentrated form of the conversion coating solution. Finally, the rest of the working volume of the tank is filled with water. In the preferred embodiment of the invention, the pH of the working bath, i.e., the diluted form of the composition is preferably in the range of 1.5–3.0, more preferably in the range of about 2.0–2.5, and most preferably in the range of 2.1–2.3.

The plated articles are dipped in the conversion coating composition bath at a temperature of about 20 to 40° C. preferably for 25–75 seconds, and more preferably about 40–60 seconds. The articles are rinsed in water, and may be then rinsed a second time in water at a temperature of 20–60° C. Following rinsing, the articles are dried.

One advantage of the present invention is the ability to form the coating without pre-baking the article to be coated to relieve any hydrogen-embrittlement. Other products require the parts to be baked prior to chromating, which also requires the surface of the parts to be reactivated prior to chromating. Baking usually destroys corrosion protection. The ability to chromate and then bake greatly simplifies the processing of the conversion coating.

The invention will be described with reference to non-limiting examples. These examples are for illustration only and are not to be construed in any limiting sense.

EXAMPLES

A series of test panels were produced to evaluate various chromate formulations. Type QD steel Q-Panels were obtained from Q-Panel Lab Products. The panels were plated in acid-chloride zinc electroplating bath consisting of 22.5 g/L zinc metal, 135 g/L potassium chloride, 45 g/L ammonium chloride, 4% (vol/vol) AmeriZinc ZCI $NH_4$, and 0.05% (vol/vol) AmeriZinc BRT II (AmeriZinc products available from Pavco, Inc.). The panels were zinc plated at 20 amps/$ft^2$ for 25–30 minutes to produce a zinc thickness of approximately 0.4 mils. After plating, the panels were first rinsed in water and then rinsed in 0.5% (vol/vol) nitric acid solution. After rinsing, the panels were chromated for 40 seconds, rinsed with water, and dried. Chromating was performed by immersing the panels in a chromating tank of water and the constituents of Table 2.

After chromating the color of the panels were determined qualitatively by visual inspection. The colors of the chromated panels also were determined quantitatively by the use of a Hunter Associates Laboratory, Inc. Labscan II colorimeter. The quantitative color measurements are expressed in International Commission on Illumination (CIE) opponent-color scale. In the CIE 1976 L*a*b* scale, L measures lightness and varies from 100 for perfect white to zero for black, approximately as the eye would evaluate it. The chromaticity dimensions, a* and b*, give color designations as follows: a* measures redness when positive, gray when zero, and greenness when negative; b* measures yellowness when positive, gray when zero, and blueness when negative.

| Example | Composition of Working Conversion Coating Solution | | | | | Mole Ratio | Salt Spray Time to White | CIE Opponent-Color scale | | | Visual |
|---|---|---|---|---|---|---|---|---|---|---|---|
| Number | [Cr3+], M | [Co2+], M | [F−], M | [HNO3], M | pH | NO3−/(Cr3++Co2+) | Salts, hrs. | L* | a* | b* | Appearance |
| 1 | 0.0365 | 0.0250 | 0.010 | 0.030 | 2.3 | 0.5 | 181 | 73.84 | −2.50 | −6.58 | blue-green |
| 2 | 0.0365 | 0.0100 | 0.005 | 0.023 | 2.3 | 0.5 | 129 | 72.95 | −2.57 | −5.58 | blue-green |
| 3 | 0.0365 | 0.0250 | 0.000 | 0.015 | 2.3 | 0.2 | 199 | 73.93 | −3.89 | −6.58 | red |
| 4 | 0.0365 | 0.0175 | 0.005 | 0.023 | 2.3 | 0.4 | 222 | 73.46 | −3.23 | −6.73 | red-blue |
| 5 | 0.0365 | 0.0100 | 0.000 | 0.015 | 2.3 | 0.3 | 233 | 73.47 | −3.35 | −6.94 | green-yellow |
| 6 | 0.0365 | 0.0175 | 0.005 | 0.023 | 2.3 | 0.4 | 281 | 74.56 | −4.07 | −6.79 | red-blue |
| 7 | 0.0365 | 0.0175 | 0.005 | 0.023 | 2.3 | 0.4 | 327 | 74.60 | −4.23 | −8.11 | blue-green |
| 8 | 0.0365 | 0.0250 | 0.000 | 0.030 | 2.3 | 0.5 | 409 | 74.77 | −4.36 | −7.51 | green-yellow |
| 9 | 0.0365 | 0.0175 | 0.005 | 0.030 | 2.3 | 0.6 | 274 | 75.58 | −4.78 | −7.91 | blue-green |
| 10 | 0.0365 | 0.0175 | 0.005 | 0.015 | 2.3 | 0.3 | 257 | 73.25 | −2.21 | −4.45 | red-blue |
| 11 | 0.0365 | 0.0100 | 0.010 | 0.015 | 2.3 | 0.3 | 321 | 73.22 | −2.26 | −6.08 | red-blue |
| 12 | 0.0365 | 0.0175 | 0.000 | 0.023 | 2.3 | 0.4 | 257 | 77.10 | −5.24 | −5.25 | green-yellow |
| 13 | 0.0365 | 0.0175 | 0.010 | 0.023 | 2.3 | 0.4 | 409 | 74.10 | −3.38 | −8.25 | red-blue |
| 14 | 0.0365 | 0.0175 | 0.005 | 0.023 | 2.3 | 0.4 | 257 | 74.16 | −3.52 | −7.39 | green |
| 15 | 0.0365 | 0.0175 | 0.005 | 0.023 | 2.3 | 0.4 | 286 | 74.85 | −4.47 | −7.99 | green-yellow |
| 16 | 0.0365 | 0.0100 | 0.000 | 0.030 | 2.3 | 0.6 | 286 | 76.62 | −5.24 | −6.68 | green-yellow |
| 17 | 0.0365 | 0.0175 | 0.005 | 0.023 | 2.3 | 0.4 | 274 | 75.99 | −5.14 | −7.64 | green-yellow |
| 18 | 0.0365 | 0.0250 | 0.005 | 0.023 | 2.3 | 0.4 | 216 | 76.09 | −5.16 | −7.17 | blue-green |
| 19 | 0.0365 | 0.0100 | 0.010 | 0.030 | 2.3 | 0.6 | 269 | 76.64 | −5.11 | −7.63 | blue-green |
| 20 | 0,0365 | 0.0250 | 0.010 | 0.015 | 2.3 | 0.2 | 251 | 74.39 | −4.10 | −8.07 | red |
| 21 | 0.0365 | 0.0250 | 0.000 | 0.030 | 2.3 | 0.5 | 148 | 78.63 | −4.20 | −3.46 | blue-green |
| 22 | 0.0365 | 0.0175 | 0.010 | 0.023 | 2.3 | 0.4 | 404 | 75.53 | −2.14 | −2.69 | red-blue |
| 23 | 0.0365 | 0.0170 | 0.010 | 0.018 | 2.3 | 0.3 | 420 | 76.32 | −3.41 | −5.21 | red-blue |
| 24 | 0.0365 | 0.0155 | 0.010 | 0.015 | 2.3 | 0.3 | 388 | 75.45 | −1.70 | −1.01 | blue-green |
| 25 | 0.0365 | 0.0250 | 0.000 | 0.030 | 3.0 | 0.5 | 583 | 78.48 | −4.29 | −2.03 | blue-green |
| 26 | 0.0365 | 0.0175 | 0.010 | 0.023 | 2.9 | 0.4 | 475 | 76.35 | −3.81 | −3.55 | blue-green |
| 27 | 0.0365 | 0.0170 | 0.010 | 0.018 | 3.6 | 0.3 | 583 | 76.32 | −2.70 | −1.53 | green |
| 28 | 0.0365 | 0.0155 | 0.010 | 0.015 | 3.6 | 0.3 | 132 | 77.05 | −1.97 | 0.79 | green-yellow |
| 29 | 0.0365 | 0.0175 | 0.010 | 0.023 | | 0.4 | 510 | 77.41 | −2.38 | 1.90 | blue-green |
| 30 | 0.0365 | 0.0175 | 0.010 | 0.023 | | 0.4 | 472 | 74.51 | −2.57 | −4.77 | red |
| 31 | 0.0365 | 0.0175 | 0.010 | 0.023 | | 0.4 | 234 | 75.86 | −4.99 | −6.11 | blue-green |
| 32 | 0.0365 | 0.0175 | 0.010 | 0.023 | | 0.4 | 510 | 77.59 | −5.76 | −4.23 | blue-green |
| 33 | 0.0365 | 0.0170 | 0.010 | 0.018 | 3.5 | 0.3 | 94 | 77.74 | −2.29 | 0.85 | yellow |
| 34 | 0.0365 | 0.0170 | 0.010 | 0.018 | 2.8 | 0.3 | 458 | 76.10 | −2.11 | −2.91 | yellow-red |
| 35 | 0.0365 | 0.0170 | 0.010 | 0.018 | 2.6 | 0.3 | 510 | 75.36 | −3.43 | −4.94 | red-blue |
| 36 | 0.0365 | 0.0170 | 0.010 | 0.018 | 2.2 | 0.3 | 510 | 76.25 | −5.09 | −3.09 | blue-green |
| 37 | 0.0365 | 0.0155 | 0.010 | 0.015 | 2.4 | 0.3 | 234 | 76.63 | −4.15 | −5.81 | blue-green |
| 37 | 0.0365 | 0.0155 | 0.010 | 0.015 | 2.0 | 0.3 | 234 | 78.12 | −5.12 | −4.80 | blue-green |
| 38 | 0.0365 | 0.0155 | 0.010 | 0.015 | 1.9 | 0.3 | 510 | 77.60 | −5.26 | −5.03 | blue-green |
| 39 | 0.0365 | 0.0155 | 0.010 | 0.015 | 1.8 | 0.3 | 425 | 75.99 | −5.24 | −5.26 | blue-green |

To evaluate the anti-corrosion effects of the conversion coating of the present invention, salt spray or fog testing was performed according to the standards of the American Society for Testing and Materials (ASTM) designation B 117-90. The testing apparatus consisted of a fog chamber, a salt solution reservoir, a supply of suitably conditioned compressed air, and atomizing nozzles. Using the apparatus, a salt solution comprised of about 5 parts by weight (pbw)

NaCl in 95 pbw of water was sprayed onto zinc-plated steel specimens for continuous prolonged periods to cause corrosion. The onset of two types of corrosion was documented: white salts and red rust. In the tests, zinc-plated steel specimens treated with the conversion coating of the present invention remained corrosion free until well after corrosion formed on untreated (control) specimens. Further, the length of time before corrosion appeared on the treated specimens was greater than specimens treated with typical conversion coatings containing hexavalent chromium.

The specific compositions and testing results are shown in Table 2. The working solutions listed in Table 2 were prepared from chromium (III) sulfate, cobalt (II) sulfate, sodium bifluoride, and nitric acid. The pH of the working solutions was adjusted with either sulfuric acid or nitric acid.

The invention has been described with reference to the preferred embodiment. Obviously, modifications and alterations will occur to others upon a reading and understanding of this specification. It is intended to include all such modifications and alterations insofar as they come within the scope of the appended claims or the equivalent thereof.

We claim:

1. A conversion coating bath including a coating composition comprising:

chromium (III) ions, cobalt (II) ions, and nitrate ions, wherein said composition is acidic, includes a ratio of nitrate ions to the combination of chromium (III) and cobalt (II) ions of less than 1.5:1, is substantially free of chromium (VI) ions, and is substantially free of oxidizing agents other than said nitrate ions.

2. The bath of claim 1 further comprising water.

3. The bath of claim 1 further comprising sulfate ions.

4. The bath of claim 1 further comprising a film polisher.

5. The bath of claim 4 wherein said film polisher comprises fluoride ions.

6. The bath of claim 1 having a pH between 1.5 and 3.0.

7. The conversion coating bath of claim 1 further comprising about:

0.020 to 0.075 mole/L chromium (III) ions, 0.010 to 0.035 mole/L cobalt (II) ions, and 0.010 to 0.045 mole/L nitrate ions.

8. An acidic conversion coating bath composition comprising:

0.020 to 0.075 mole/L chromium (III) ions, 0.010 to 0.035 mole/L cobalt (II) ions, a film polisher agent, and about 0.010 to 0.045 mole/L nitrate ions, said composition including a ratio of nitrate ions to the combination of chromium (III) and cobalt (II) ions of less than 1.5:1, being substantially free of chromium (VI) ions and substantially free of oxidizing agents other than said nitrate ions.

9. The composition of claim 8 wherein said film polishing agent comprises fluoride ions.

10. The composition of claim 8 having a pH between 1.5–3.0.

11. A concentrate for forming a conversion coating bath comprising:

chromium (III), cobalt (II), and nitric acid, wherein said concentrate is acidic, is substantially free of chromium (VI) ions, is substantially free of oxidizing agents other than said nitric acid, and includes less than a 1.5 to 1 ratio of nitric acid to chromium (III) plus cobalt (II).

12. A method for applying a conversion coating onto an article comprising the steps of:

plating the article with zinc, and exposing the article to an acidic conversion coating composition comprising water, chromium (III) ions, cobalt (II) ions, fluoride ions, and nitrate ions, said conversion coating being substantially free of chromium (VI) ions and substantially free of oxidizing agents other than said nitrate ions, and including a ratio of nitrate ions to chromium (III) and cobalt (II) ions of less than 1.5:1.

13. The method of claim 12 wherein the coating composition is at a temperature of about 20–40° C.

14. The method of claim 12 wherein the step of exposing the article to the conversion coating composition is performed for about 25–75 seconds.

15. The method of claim 12 wherein the conversion coating composition comprises:

0.020 to 0.075 mole/L chromium (III) ions, 0.010 to 0.035 mole/L cobalt III) ions, and 0.010 to 0.045 mole/L nitrate ions.

16. A method for applying a colored conversion coating onto an article comprising the steps of:

plating the article with zinc, exposing the article to an acidic conversion coating composition comprising water, chromium (III) ions, cobalt (II) ions, fluoride ions, and nitrate ions, said conversion coating having a ratio of nitrate ions to the combination of chromium (III) and cobalt (II) ions of less than 1.5:1, and being substantially free of chromium (VI) ions and substantially free of oxidizing agents other than said nitrate ions, rinsing the article exposing the article to a dye solution, and rinsing the article.

17. The method of claim 16 wherein the coating composition is at a temperature of about 20–40° C.

18. The method of claim 16 wherein the step of exposing the article to a conversion coating composition is performed for about 25–75 seconds.

19. The method of claim 16 wherein the step of rinsing the article after exposing the article to the conversion coating is performed in water having a temperature between about 20–40° C.

20. The method of claim 16 wherein the step of exposing the article to a dye solution is performed for about 5–40 seconds.

21. The method of claim 16 wherein the dye solution is at a temperature of about 20–40° C.

22. The method of claim 16 wherein the dye solution has a pH between about 9–12.

23. The method of claim 16 wherein the dye solution includes a Mordant diazo dye and borate ions.

24. The method of claim 16 wherein the water of the step of rinsing the article after exposing the article to the conversion coating composition is at a temperature between about 20–60° C.

* * * * *